US008820112B2

(12) United States Patent
Cur et al.

(10) Patent No.: US 8,820,112 B2
(45) Date of Patent: Sep. 2, 2014

(54) FLEXIBLE COOLING SYSTEM INTEGRATION FOR MULTIPLE PLATFORMS

(75) Inventors: Nihat Cur, Saint Joseph, MI (US); Alberto R. Gomes, Saint Joseph, MI (US); Luiz Antonio D. Lopes, Peachtree City, GA (US); Guolian Wu, Saint Joseph, MI (US); Luciana Wasnievski Da Silva, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/108,293

(22) Filed: May 16, 2011

(65) Prior Publication Data

US 2012/0291477 A1 Nov. 22, 2012

(51) Int. Cl.
*F25D 19/02* (2006.01)

(52) U.S. Cl.
CPC ..... *F25D 19/02* (2013.01)
USPC ..... 62/448

(58) Field of Classification Search
CPC ..... F25B 39/00; F25B 41/00; F25B 41/006; F25D 19/02
USPC ..... 62/79–80, 114, 115, 118, 151, 234, 62/244, 259.2, 268–270, 335, 419, 62/440–441, 426, 444, 449, 467, 498, 515, 62/448; 312/404; 165/80.2
See application file for complete search history.

(56) References Cited

U.S. PATENT DOCUMENTS 2,252,010 A 8/1941 Krackowizer
2,387,465 A 10/1945 Peltier
2,445,988 A 7/1948 Ayres
2,511,127 A 6/1950 Philipp
2,713,776 A 7/1955 Smith
2,735,277 A 2/1956 Clark
2,815,649 A 12/1957 Angelus et al.

(Continued)

FOREIGN PATENT DOCUMENTS

CA 2450877 A1 * 5/2007 ..... F25D 19/02
FR 1136547 A * 5/1957 ..... F25D 19/02

(Continued)

OTHER PUBLICATIONS

European Patent Application No. 12167710.8 filed May 11, 2012, Applicant: Whirlpool Corporation; Extended European Search, mail date Oct. 18, 2013.

*Primary Examiner* — Frantz Jules
*Assistant Examiner* — Emmanuel Duke

(57) ABSTRACT

A refrigerator is provided that includes a CMS adapted to define at least a portion of an envelope of at least one of a freezer compartment and a refrigerator compartment, where the CMS has a high pressure side and a low pressure side. The high pressure side includes an orientation-flexible compressor and a condenser fluidly connected with the orientation-flexible compressor. The low pressure side is fluidly connected to the high pressure side and includes an evaporator. The CMS also includes at least one housing configured to enclose at least one of the orientation-flexible compressor, the condenser, and the evaporator. The CMS further includes an insulating panel forming at least a portion of the at least one housing, and substantially separating the high pressure side from the low pressure side. The CMS is typically configured to operate in a plurality of orientations based upon the orientation-flexible compressor.

25 Claims, 9 Drawing Sheets

(56) References Cited

U.S. PATENT DOCUMENTS

| | | | | | |
|---|---|---|---|---|---|
| 2,827,118 | A | | 3/1958 | Wendt | |
| 3,122,005 | A | | 2/1964 | Costantini et al. | |
| 3,650,122 | A | | 3/1972 | Lieberman | |
| 3,708,997 | A | | 1/1973 | McLaughlin | |
| 3,712,078 | A | * | 1/1973 | Maynard et al. | 62/448 |
| 3,726,578 | A | | 4/1973 | Armstrong | |
| 4,019,339 | A | | 4/1977 | Anderson | |
| 4,088,466 | A | | 5/1978 | Humphrey et al. | |
| 4,151,726 | A | | 5/1979 | Schlueter | |
| 4,410,033 | A | | 10/1983 | Wawro et al. | |
| 4,416,122 | A | * | 11/1983 | Johnson | 62/448 |
| 4,638,644 | A | | 1/1987 | Gidseg | |
| 4,893,478 | A | | 1/1990 | Kruck et al. | |
| 4,907,419 | A | | 3/1990 | Kruck et al. | |
| 4,917,256 | A | | 4/1990 | Kruck et al. | |
| 4,962,649 | A | | 10/1990 | Battocletti | |
| 5,009,081 | A | | 4/1991 | Kruck et al. | |
| 5,186,022 | A | | 2/1993 | Kim | |
| 5,231,847 | A | * | 8/1993 | Cur et al. | 62/187 |
| 5,284,023 | A | * | 2/1994 | Silva et al. | 62/77 |
| 5,375,428 | A | | 12/1994 | LeClear et al. | |
| 5,577,822 | A | | 11/1996 | Seon | |
| 5,809,789 | A | * | 9/1998 | Baker et al. | 62/81 |
| 6,070,424 | A | * | 6/2000 | Bauman et al. | 62/279 |
| 6,192,704 | B1 | | 2/2001 | Hiro et al. | |
| 6,519,970 | B1 | | 2/2003 | Rafalovich et al. | |
| 6,637,231 | B1 | * | 10/2003 | Monfarad | 62/259.2 |
| 7,032,408 | B2 | | 4/2006 | Dentella et al. | |
| 7,237,402 | B2 | | 7/2007 | Hallin et al. | |
| 7,251,954 | B2 | * | 8/2007 | Fee et al. | 62/448 |
| 7,360,575 | B2 | | 4/2008 | Weiss | |
| 7,377,124 | B2 | | 5/2008 | Kim et al. | |
| 7,908,873 | B1 | * | 3/2011 | Cur et al. | 62/115 |
| 2005/0150250 | A1 | | 7/2005 | Allison et al. | |
| 2006/0086126 | A1 | | 4/2006 | Montuoro | |
| 2007/0228907 | A1 | * | 10/2007 | Luisi et al. | 312/404 |
| 2008/0011013 | A1 | | 1/2008 | Junge | |
| 2009/0107162 | A1 | * | 4/2009 | Su et al. | 62/263 |
| 2009/0165488 | A1 | | 7/2009 | Chen | |
| 2010/0058791 | A1 | * | 3/2010 | Quesada Saborio | 62/259.1 |
| 2012/0085123 | A1 | | 4/2012 | Wasnievski da Silva et al. | |
| 2012/0291475 | A1 | | 11/2012 | Cur et al. | |
| 2012/0291477 | A1 | | 11/2012 | Cur et al. | |

FOREIGN PATENT DOCUMENTS

| | | | | | |
|---|---|---|---|---|---|
| JP | 11182979 | | | 7/1999 | |
| JP | 2007017058 | A | * | 1/2007 | F25D 19/02 |
| WO | 2009033243 | A2 | | 3/2009 | |
| WO | WO2009033243 | | * | 3/2009 | F25D 19/02 |
| WO | 2010043009 | A2 | | 4/2010 | |
| WO | WO 2010043009 | | * | 4/2010 | F25D 19/02 |
| WO | WO 2010043009 | A2 | * | 4/2010 | F25D 19/02 |

* cited by examiner

FLEXIBLE COOLING SYSTEM INTEGRATION FOR MULTIPLE PLATFORMS

FIELD OF THE INVENTION

The present invention generally relates to a cooling module set, and more particularly, a refrigerator having a cooling module set configured to operate in any of a plurality of orientations.

BACKGROUND OF THE INVENTION

Generally, refrigerators have their cooling system configured in a way that a modular product is not a practical possibility without substantial redesign and investment, nor is it easy to manufacture various product configurations without substantial investments. Typically, the product introductions and product performances are impacted by complexities imposed by the cooling system within the cabinet construction. Cooling system components in modules are generally widely dispersed and intermingled within the cabinet configuration with a loosely formed high side and low side modules, wherein each product configuration can have unique high side and low side module configurations that require entirely different designs.

SUMMARY OF THE INVENTION

According to one aspect of the present invention, a structure typically an appliance, more typically a refrigerator, is provided that includes at least one freezer compartment, at least one refrigerator compartment, and a cooling module set (CMS) containing mullion adapted to define at least a portion of an envelope of at least one of the freezer compartment and the refrigerator compartment. The CMS has a high pressure side and a low pressure side. The high pressure side includes a condenser and the low pressure side is fluidly connected to the high pressure side and includes an evaporator. The CMS also includes at least one housing configured to enclose at least one of the condenser and the evaporator. The CMS further includes an insulating panel forming at least a portion of the at least one housing, and substantially separating the high pressure side from the low pressure side, wherein the CMS is configured to operate in a plurality of orientations.

According to another aspect of the present invention, a refrigerator is provided that includes at least one freezer compartment, at least one refrigerator compartment, and a cooling module set (CMS) adapted to define at least a portion of an envelope of at least one of the freezer compartment and the refrigerator compartment. The CMS typically includes a high pressure side and a low pressure side. The high pressure side includes an orientation-flexible compressor configured to be mounted in a plurality of orientations, a condenser fluidly connected with the orientation-flexible compressor, and a condenser fan. The low pressure side is fluidly connected to the high pressure side and includes an evaporator having a defroster device, an evaporator fan, and an evaporator coil that includes a plurality of fins configured to have a contour allowing moisture to move across the contour and off of the fins when the CMS is in one of the a plurality of orientations. The CMS further typically includes at least one housing configured to enclose at least one of the orientation-flexible compressor, the condenser, and the evaporator. The CMS further typically includes an insulating panel forming at least a portion of the at least one housing, and substantially separating the high pressure side from the low pressure side and configured to insulate against heat gain from external conditions with respect to the low pressure side. The CMS is configured to operate in the plurality of orientations based upon the orientation-flexible compressor and the evaporator coil, the plurality of orientations including approximately vertically in parallel with a normal operating orientation of the refrigerator, approximately horizontally with respect to the normal operating orientation of the refrigerator, rotated approximately ninety degrees (90°) about an x-axis, and rotated approximately one hundred eighty degrees (180°) about a z-axis.

According to yet another aspect of the present invention, a cooling module set (CMS) adapted to define at least a portion of at least one of a freezer compartment and a refrigerator compartment in a refrigerator is provided. The CMS includes a high pressure side having an orientation-flexible compressor configured to be mounted in a plurality of orientations and a condenser fluidly connected with the orientation-flexible compressor, and a low pressure side fluidly connected to the high pressure side, wherein the low pressure side includes an evaporator having an evaporator fan and an evaporator coil that includes a plurality of fins configured to have a contour allowing defrost water to move across the contour and off of the fins when the CMS is in one of a plurality of orientations. The CMS further typically includes at least one housing configured to enclose at least one of the orientation-flexible compressor, the condenser, the evaporator fan, and the evaporator coil, and an insulating panel forming at least a portion of the at least one housing, and substantially separating the high pressure side from the low pressure side, wherein the CMS is configured to operate in the plurality of orientations based upon the orientation-flexible compressor and the evaporator coil, the plurality of orientations including approximately vertically in parallel with a normal operating orientation of the refrigerator, approximately horizontally with respect to the normal operating orientation of the refrigerator, rotated approximately ninety degrees (90°) about an x-axis, and rotated approximately one hundred eighty degrees (180°) about a z-axis.

Another aspect of the present invention includes a method of producing an appliance that comprises the steps of: forming an insulated appliance cabinet having an interior and an exterior defined by walls; and installing a cooling module set comprising: a low pressure side and a high pressure side capable of operation sufficient to allow the cooling module set to perform its cooling function within a plurality of orientations including at least when the orientation flexible compressor is oriented vertically or when the orientation flexible compressor is oriented horizontally, wherein the cooling module set is installed such that the cooling module set forms at least one of the following structures: at least a portion of a vertical mullion, at least a portion of a horizontal mullion and/or at least a portion of the generic appliance cabinet walls.

These and other aspects, objects, and features of the present invention will be understood and appreciated by those skilled in the art upon studying the following specification, claims, and appended drawings.

DETAILED DESCRIPTION

For purposes of description herein, the terms "upper," "lower," "right," "left," "rear," "front," "vertical," "horizontal," and derivatives thereof shall relate a cooling module set (CMS). However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 6A:
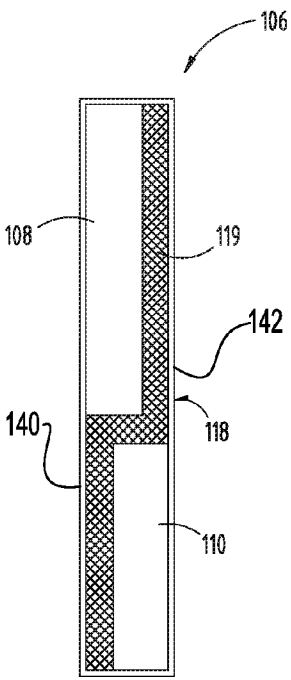
FIG. 6*a* is a schematic diagram of a vertically oriented cooling module set, in accordance with one embodiment of the present invention.
Figure 6B:
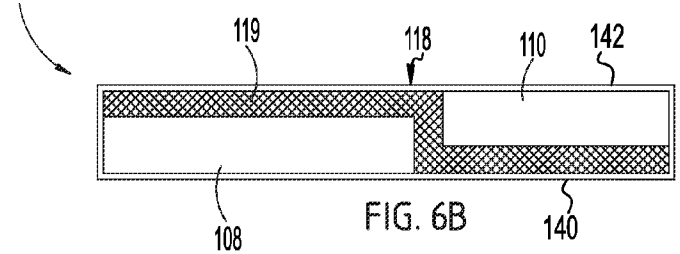
FIG. 6*b* is a schematic diagram of a horizontally oriented cooling module set, in accordance with one embodiment of the present invention.

With respect to FIGS. 1A-12, a refrigerator is generally shown in FIGS. 1A-1I at reference identifier 100. The refrigerator 100 can include at least one freezer compartment 102 and at least one refrigerator compartment 104. The refrigerator 100 can further include a CMS generally indicated at reference identifier 106. The CMS 106 can be adapted to define at least a portion of an envelope of the freezer compartment 102, the refrigerator compartment 104, or a combination thereof. The CMS 106 can have a high pressure side 108 and a low pressure side 110. The high pressure side 108 of the CMS 106 can include an orientation-flexible compressor 112, a condenser 113 fluidly connected with the orientation-flexible compressor 112 (FIG. 3), or a combination thereof. The low pressure side 110 of the CMS 106 can include an evaporator, generally indicated at reference identifier 115 (FIG. 3). Typically, the evaporator 115 includes at least one evaporator fan 116 proximate an evaporator coil 114. As shown in FIGS. 6*a* and 6*b*, the CMS 106 can further include at least one housing 118 adapted to enclose the orientation-flexible compressor 112, the condenser 113, the evaporator 115, or a combination thereof, and an insulating panel 119 forming at least a portion of the housing 118, and substantially separating the high pressure side 108 and the low pressure side 110. The CMS 106 can be configured to operate in any of a plurality of orientations, as described in greater detail herein and shown in generally vertical (FIG. 6*a*) and horizontal (FIG. 6*b*) orientations. A portion of the CMS can optionally define all or part of an exterior wall 140 and interior wall 142. Typically, the various operating positions of the CMS 106 are based upon the orientation-flexible compressor 112.

Figure 12:
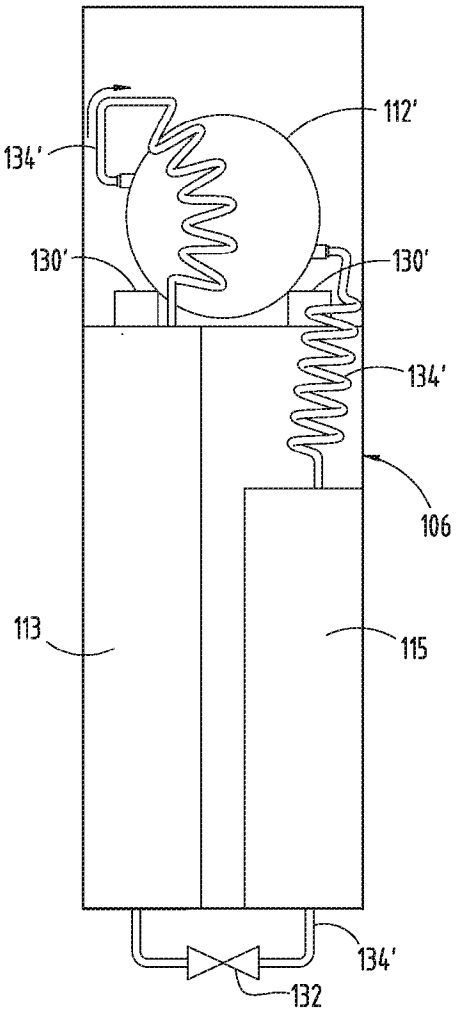
FIG. 12 is a schematic diagram of a cooling module set in a vertical orientation, the cooling module set having a repositionable compressor, in accordance with one embodiment of the present invention.
Figure 10:
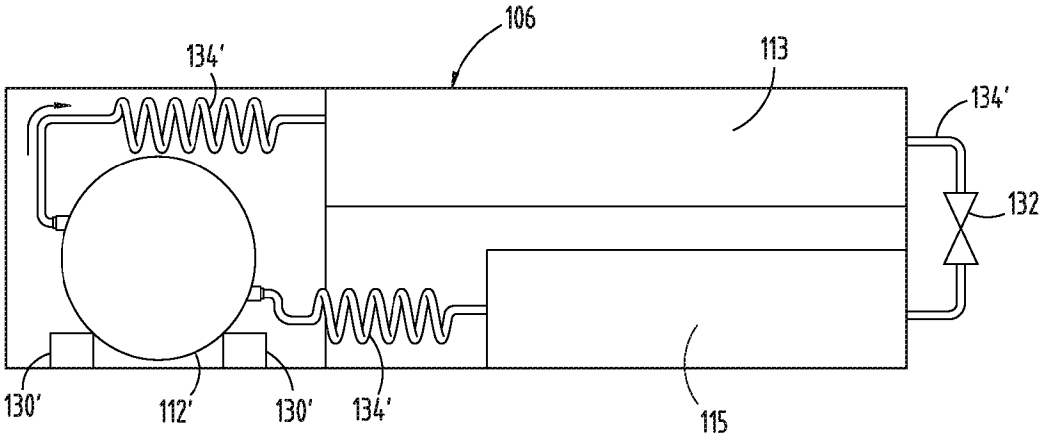
FIG. 10 is a schematic diagram of a cooling module set in a horizontal orientation, the cooling module set having a repositionable compressor, in accordance with one embodiment of the present invention.
Figure 11:
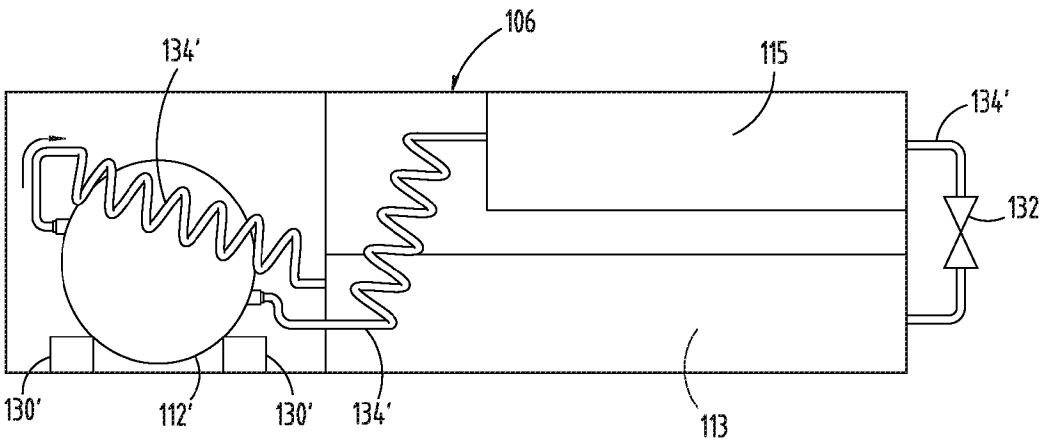
FIG. 11 is a schematic diagram of a cooling module set in a horizontal orientation, the cooling module set having a repositionable compressor, in accordance with one embodiment of the present invention.

For purposes of explanation and not limitation, in operation, the orientation-flexible compressor 112 can be configured to operate in various positions, and thus, the CMS 106 can be placed within the refrigerator 100 in various positions based upon the orientation of the orientation-flexible compressor 112 within the CMS 106. Therefore, the CMS 106 can be a standard configuration for various refrigerator models, and then placed within different portions of the refrigerator 100 based upon the particular refrigerator 100 design without (mechanical) modification to the orientation-flexible compressor. According to an alternate embodiment, the compressor 112' can be a repositionable compressor, as illustrated in FIGS. 10-12, and discussed in greater detail herein. The high pressure side 108 and the low pressure side 110 can be operably connected allowing for increase orientations of the CMS 106 with respect to the refrigerator.

Figure 5:
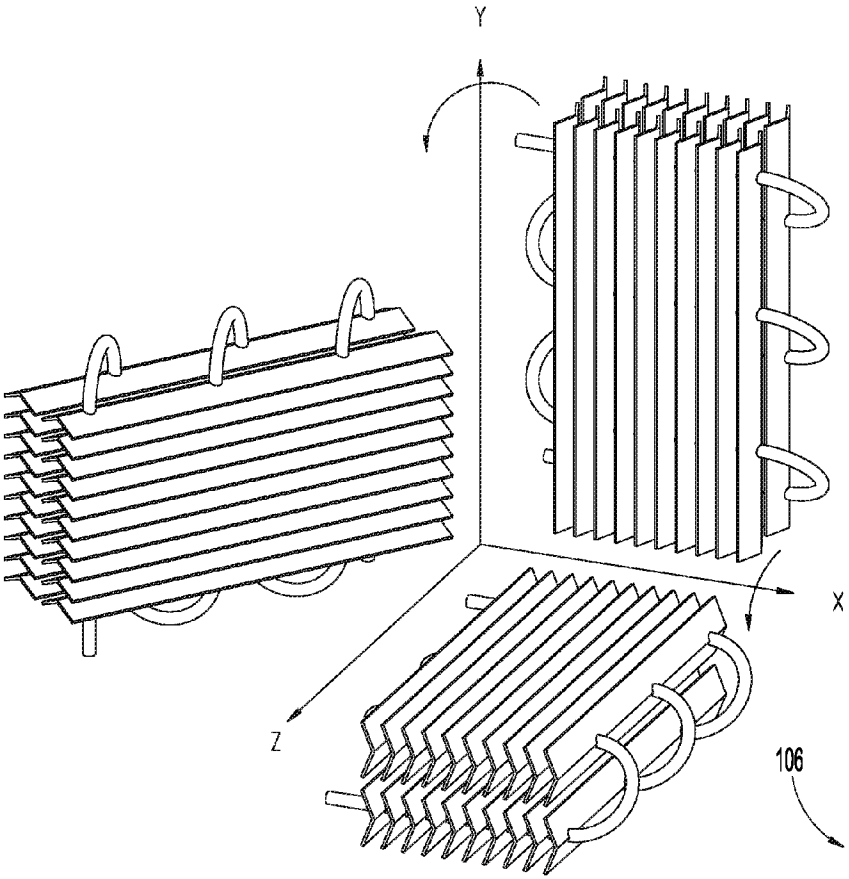
FIG. 5 is a chart illustrating x, y, z axis with respect to exemplary operating orientations of a cooling module set, in accordance with one embodiment of the present invention.

According to one embodiment, as illustrated in FIG. 5, the CMS 106 can be configured to operate when positioned in approximately a vertical position in parallel with a normal operating orientation of the refrigerator 100, approximately horizontally with respect to the normal operating orientation of the refrigerator 100, rotated approximately ninety degrees (90°) (e.g., +/−90° from an axis of origin), rotated approximately one hundred eighty degrees (180°) (e.g., +/−180° from an axis of origin), rotated approximately two hundred seventy degrees (270°) (e.g., +/−270° from an axis of origin), the like, or a combination thereof. However, it should be appreciated by those skilled in the art that the CMS 106 can be configured to operate when in other suitable orientations. Typically, the plurality of operating orientations of the CMS 106 based upon the operating orientations of the orientation-flexible compressor 112, the position of the repositionable compressor 112', the evaporator 115, or a combination thereof. According to one embodiment, the orientation-flexible compressor 112 can be an oil-less compressor. An exemplary CMS and non-orientation-flexible compressor are described in International Publication No. WO 2010/043009, entitled "REFRIGERATING MODULE FOR REFRIGERATOR APPARATUS OF FORCED VENTILATION AND REFRIGERATOR APPARATUS," the entire disclosure hereby being incorporated herein by reference.

According to one embodiment, the refrigerator 100 can further include a mullion 122 (FIGS. 1A, 1C-1E, and 1G-1I) configured to define at least a portion of the envelope of the freezer compartment 102 and the refrigerator compartment 104. The mullion 122 can also be configured to be positioned and extend approximately vertical with respect to a normal operating position of the refrigerator 100, approximately horizontal with respect to a normal operating position of the refrigerator 100, or a combination thereof. The refrigerator 100 having at least one freezer compartment 102 and at least one refrigerator compartment 104 can include a refrigerator 100 having one freezer compartment 102 and one refrigerator compartment 104, as illustrated herein for purposes of explanation and not limitation, a refrigerator 100 having two or more freezer compartments 102, and/or a refrigerator 100 having two or more refrigerator compartments 104.

With respect to FIGS. 1A-1I, 6*a* and 6*b*, at least a portion of the housing 118 can include an insulated wall section 123, according to one embodiment. Typically, the insulated wall section 123 can define a substantial portion of a wall section 123 of the freezer compartment 102, the refrigerator compartment 104, or a combination thereof. In such an embodiment, by integrating an insulated wall section 123 with the CMS 106, a compactness of the CMS can be increased, such as, but not limited to, reducing a wall thickness at least partially separating the high pressure side 108 and the low pressure side 110.

Typically, the insulated panel 119 defines a substantial portion of the wall section, including the insulated wall section 123 of the freezer compartment 102, the refrigerator compartment 104, or a combination thereof. Additionally or alternatively, the insulated panel 119 can define a substantial portion of a door section of the freezer compartment 102, the refrigerator compartment 104, or a combination thereof. The insulated panel 119 can be configured to insulate against heat gain for external conditions with respect to the low pressure side 110. In other words, the insulated panel 119 can be configured to insulate a portion of the CMS 106 from another portion of the CMS 106, ambient conditions or surroundings, other components of the refrigerator 100, the like, or a combination thereof. By way of explanation and not limitation, the insulated wall section 123 can be a vacuum panel insulated wall section.

According to one embodiment, the CMS 106 can be adapted to be reconfigurable with respect to the freezer compartment 102, the refrigerator compartment 104, or a combination thereof, such that a shape of the freezer compartment 102, the refrigerator compartment 104, or a combination thereof is altered. In such an embodiment (see FIGS. 13-14), the CMS 106 can be adapted to be reconfigurable to alter a ratio of the freezer compartment 102 and the refrigerator compartment 104. In an embodiment, wherein the refrigerator 100 is a multi-door refrigerator 100, the refrigerator 100 can include first and second reconfigurable doors. Typically, a size of the first door can be reconfigurable to correspond to the freezer compartment 102, and the size of the second door can be reconfigurable to correspond to the refrigerator compartment 104. Additionally, the mullion 122 can be configured to be repositionable. The repositioning of the mullion 122 can correspond to the reconfiguring of the first and second reconfigurable doors.

Figure 1C:
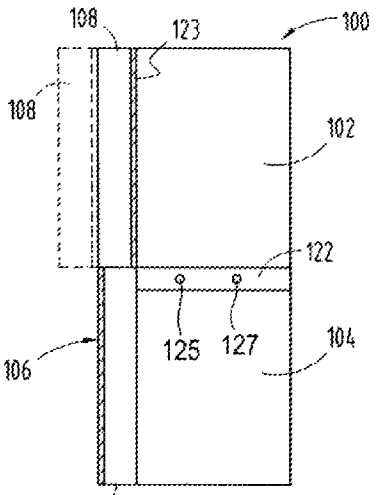
FIG. 1C is a schematic diagram of a third configuration of a cooling module set within a refrigerator, in accordance with one embodiment of the present invention.
Figure 1B:
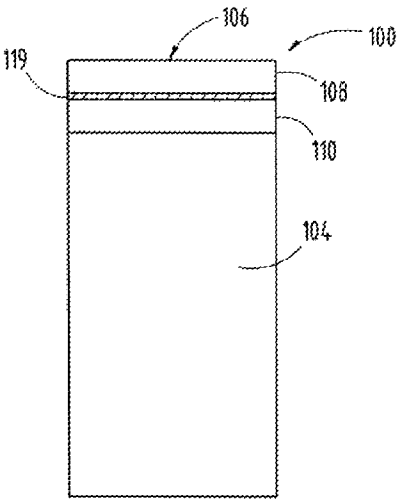
FIG. 1B is a schematic diagram of a second configuration of a cooling module set within a refrigerator, in accordance with one embodiment of the present invention.
Figure 1A:
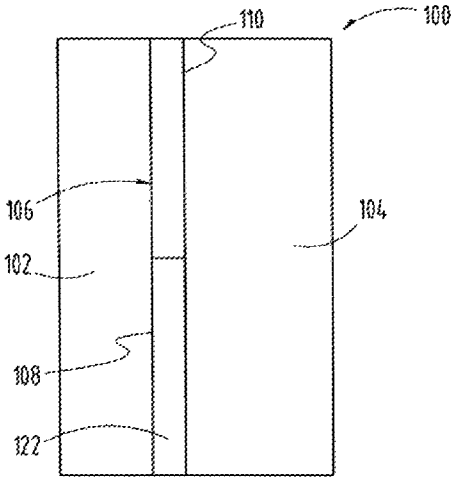
FIG. 1A is a schematic diagram of a first configuration of a cooling module set within a refrigerator, in accordance with one embodiment of the present invention.
Figure 1E:
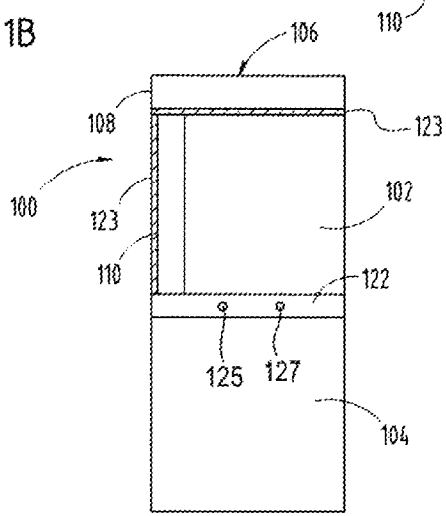
FIG. 1E is a schematic diagram of a fifth configuration of a cooling module set within a refrigerator, in accordance with one embodiment of the present invention.
Figure 1D:
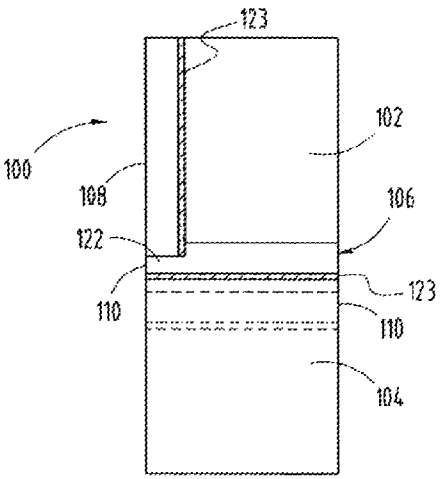
FIG. 1D is a schematic diagram of a fourth configuration of a cooling module set within a refrigerator, in accordance with one embodiment of the present invention.
Figure 1G:
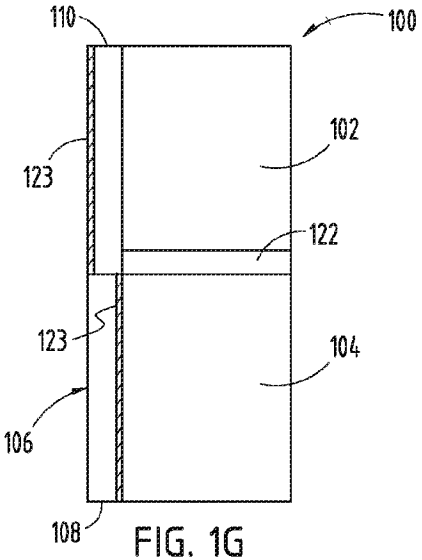
FIG. 1G is a schematic diagram of a seventh configuration of a cooling module set within a refrigerator, in accordance with one embodiment of the present invention.
Figure 1I:
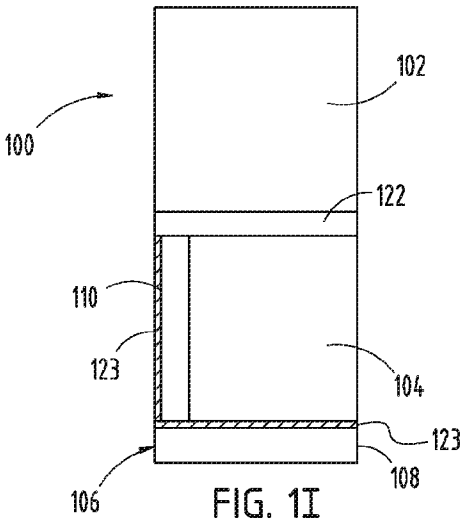
FIG. 1I is a schematic diagram of a ninth configuration of a cooling module set within a refrigerator, in accordance with one embodiment of the present invention.
Figure 1F:
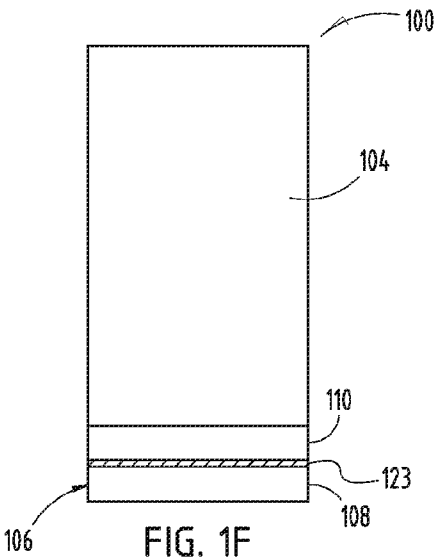
FIG. 1F is a schematic diagram of a sixth configuration of a cooling module set within a refrigerator, in accordance with one embodiment of the present invention.
Figure 1H:
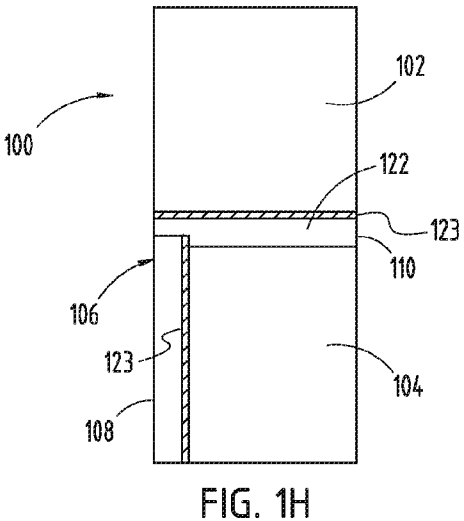
FIG. 1H is a schematic diagram of an eighth configuration of a cooling module set within a refrigerator, in accordance with one embodiment of the present invention.
Figure 2:
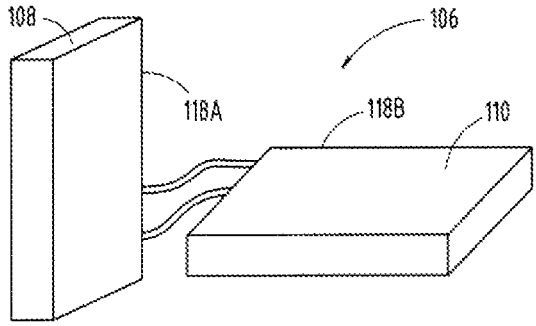
FIG. 2 is a perspective view of a cooling module set having a high side module operably connected to a low side module, in accordance with one embodiment of the present invention.
Figure 2A:
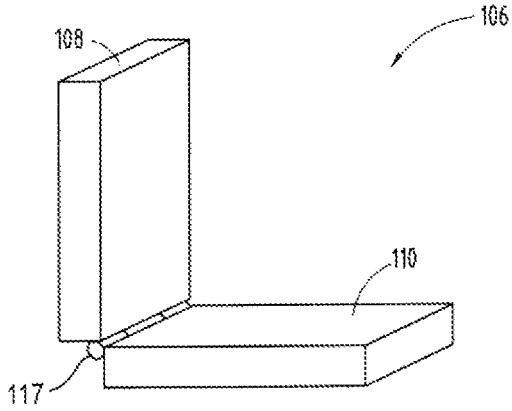
Figure 3:
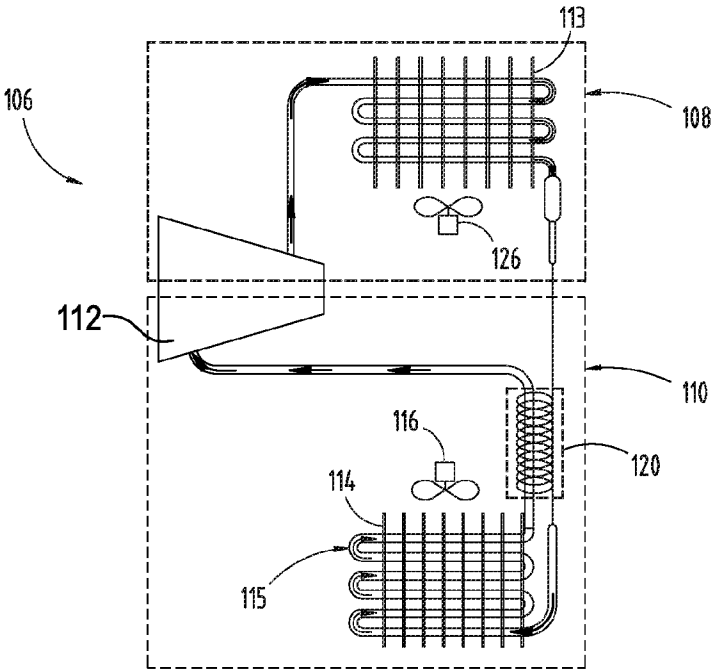
FIG. 3 is a schematic diagram of a refrigeration system, in accordance with one embodiment of the present invention.

As exemplary illustrated in FIGS. 2 and 3, the housing 118 (FIG. 2) can include a first housing 118A and a second housing 118B that are operably connected. In such an embodiment, the first housing 118A can be a high pressure side 108 and encloses the orientation-flexible compressor 112, which typically operates in any orientation without modification, a condenser 113, a condenser fan 126, other components, or a combination thereof. The second housing 118B can be a low pressure side 110, and enclose an evaporator coil 115, the evaporator fan 116, a defroster device, an expansion device 120, other components, or a combination thereof.

According to an embodiment wherein the CMS 106 can be at least partially or entirely enclosed in the mullion 122, one or more of the components of the CMS 106 can be placed within spaces created in the mullion 122 that can separate the freezer compartment 102 and the refrigerator compartment 104, other suitable compartments in the refrigerator 100, or a combination thereof. Typically, such module placement or docking of the CMS 106 within the mullion 122 can be based upon the flexibility in orientation of the orientation-flexible compressor 112 or the repositionable compressor 112'.

Additionally, the CMS 106 can include multiple docking ports that are configured to operably connect with the compressor 112, 112'. The CMS 106 can be used in various refrigerator 100 designs, without requiring different housing 118 designs. Thus, the compressor 112, 112' can operably connect to one of the docking ports of the CMS 106, such that the CMS 106 can be used in various environments.

An alternate embodiment, wherein the CMS 106 can be at least partially enclosed in the mullion 122, can include the CMS 106 having the first and second housings 118A, 118B (FIG. 2). In such an embodiment, the second housing 118B (e.g., low pressure module) can be enclosed within the mullion 122. The second housing 118B can be in close proximity to the first housing 118A (e.g., the high pressure module), which can include the orientation-flexible compressor 112, and the first and second housings 118A, 118B can be operably connected to one another. Typically, the CMS 106 can have a reduced amount of interfaces with a cabinet of the refrigerator 100.

With such an operable connection between the first and second housings 118A, 1188, the CMS 106 can be adapted to be in a planar orientation (FIGS. 1A and 1G), an approximately ninety degree (90°) orientation (FIG. 1D, 1E, 1H, or 1I), a stacked orientation (FIGS. 18 and 1F), an offset orientation (FIGS. 1C and 1D), or the like. Typically, the operable connection between the first and second housings 118A, 1188 can be a rotatable connection, typically a hinged connection 117. However, it should be appreciated by those skilled in the art that other suitable operable connections between the first and second housings 118A, 1188 can be utilized.

Figure 9:
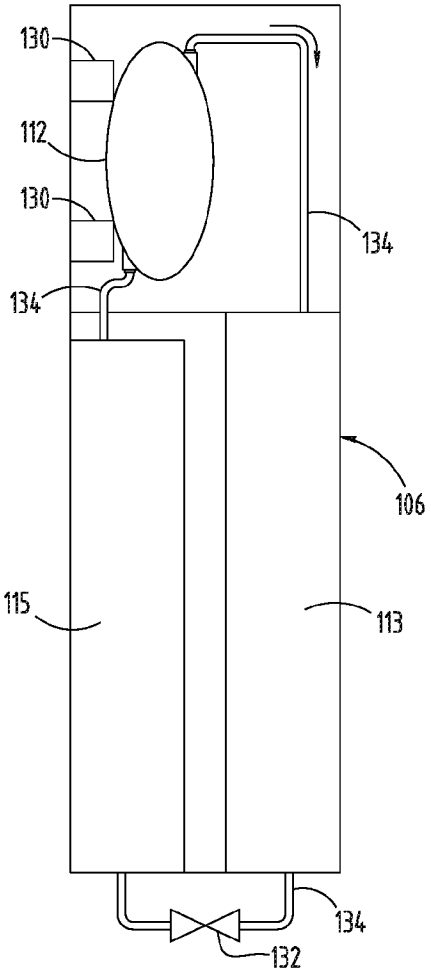
FIG. 9 is a schematic diagram of a cooling module set in a vertical orientation, the cooling module set having an orientation-flexible compressor, in accordance with one embodiment of the present invention.
Figure 7:
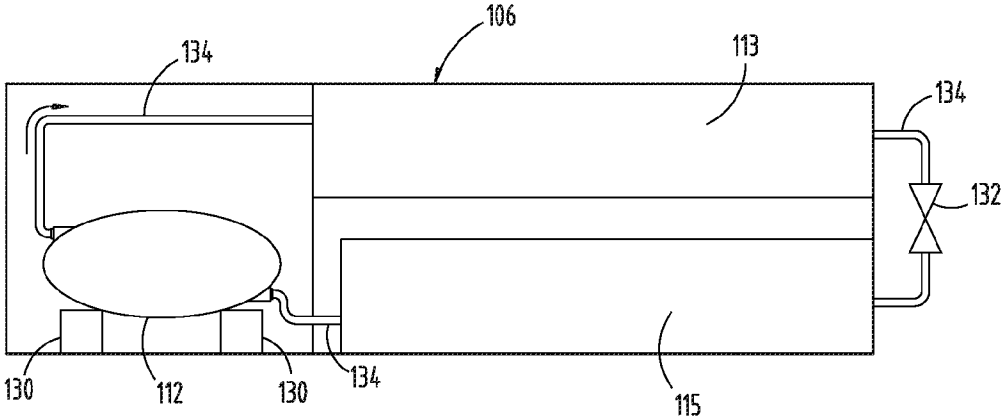
FIG. 7 is a schematic diagram of a cooling module set in a horizontal orientation, the cooling module set having an orientation-flexible compressor, in accordance with one embodiment of the present invention.
Figure 8:
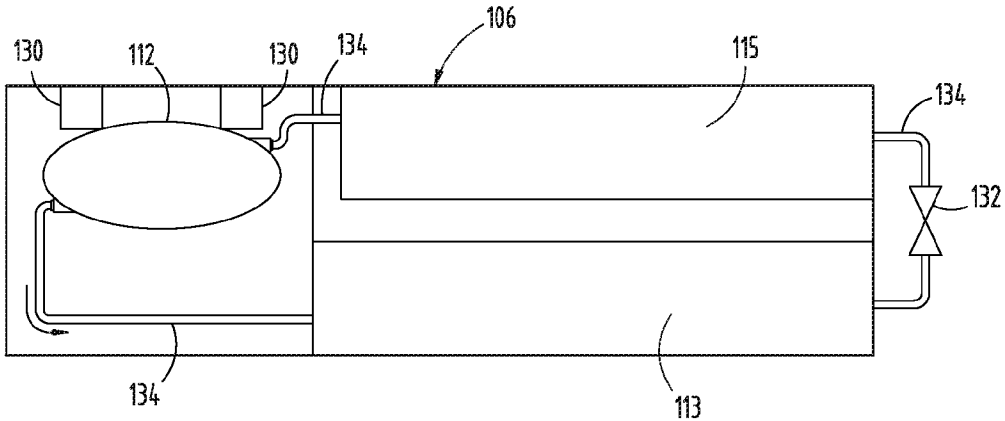
FIG. 8 is a schematic diagram of a cooling module set in a horizontal orientation, the cooling module set having an orientation-flexible compressor, in accordance with one embodiment of the present invention.

With respect to FIGS. 7-9, the CMS 106 is exemplary illustrated in a plurality of positions, wherein the CMS 106 includes the orientation-flexible compressor 112. FIG. 8 illustrates the CMS 106 rotated approximately one hundred eighty degrees (180°) from the position illustrated in FIG. 7. FIG. 9 illustrates the CMS 106 rotated approximately ninety degrees (90°) from the position illustrated in FIG. 7. Typically, the orientation of the orientation-flexible compressor within the CMS 106 does not need to be altered as the orientation of the CMS 106 is changed. The orientation-flexible compressor 112 can be non-releasably connected to the CMS 106 (e.g., to an interior side of the housing 118) by one or more fastening devices 130. Further, connections 134 between the orientation-flexible compressor 112 and the other components of the CMS 106 (e.g., the condenser 113 and the evaporator 115) may not be flexible or changeable based upon the orientation of the CMS 106 being altered. The connection between the condenser 113 and the evaporator 115 can have a throttle or expansion valve 132. It should be appreciated by those skilled in the art that the CMS 106 having the orientation-flexible compressor 112 can be orientated in other orientations not illustrated in FIGS. 7-9.

As to FIGS. 10-12, the CMS 106 is exemplary illustrated in a plurality of positions, wherein the CMS 106 includes the repositionable compressor 112'. The repositionable compressor 112' can be a standard compressor with oil (e.g., non-oilless compressor) that is adapted to be repositioned within the CMS 106. For purposes of explanation and not limitation, the repositionable compressor 112', during operation, is stable with an approximately horizontal orientation due to a flow of a lubricating material. Typically, the repositionable compressor 112' can include one or more releasable fastening devices 130' that are configured to adequately securely connect the repositionable compressor 112' to the CMS 106 (e.g., to an interior side of the housing 118). The connections 134' between the repositionable compressor 112' and other components of the CMS 106 (e.g., the condenser 113 and the evaporator 115) can be a flexible material, such as, but not limited to, elastomer (e.g., YELLOW JACKET™), thick-walled soft copper tubing, coiled tubing, the like, or a combination thereof.

FIG. 11 illustrates the CMS 106 rotated approximately one hundred eighty degrees (180°) from the position illustrated in FIG. 10. FIG. 12 illustrates the CMS 106 rotated approximately ninety degrees (90°) from the position illustrated in FIG. 10. It should be appreciated by those skilled in the art that the CMS 106 having the repositionable compressor 112' can be orientated in other orientations not illustrated in FIGS. 10-12.

In an embodiment wherein at least a portion of the housing 118 can include the insulated wall section 123, the CMS 106 can have at least the compressor 112, 112' and the condenser 113 on a first side (e.g., the high pressure side 108 and/or the first housing 118A) separated by the insulated wall 123, from at least the evaporator coil 115 on a second side (e.g., the low pressure side 110 and/or the second housing 11813). The freezer compartment 102 and the refrigerator compartment 104 can be reconfigured during the design and manufacturing process, by the post-sale consumer, or a combination thereof while utilizing the same CMS 106 design, such that the CMS 106 can be in any one of a plurality of operating orientations (FIGS. 1A-1I). Thus, the CMS 106 can utilize at least a portion of an external wall of a cabinet of the refrigerator 100 or a portion of such a wall within an aperture or enclosure. The vacuum panel insulated wall 123 can be used to reduce an amount of space occupied by the CMS 106 within the refrigerator 100. For purposes of explanation and not limitation, the CMS 106 can be used with a back wall, a top wall, a bottom wall, a door assembly, or a combination thereof, of the refrigerator 100. The CMS 106 can have a single motor that supplies power to both the evaporator fan 116 and the condenser fan 126.

According to one embodiment (see FIGS. 13-14), the refrigerator 100 can include flexible or re-adjustable compartments (e.g., the freezer compartment 102 and the refrigerator compartment 104), a portable CMS 106 that is operably connected to the refrigerator 100, but housed external to the refrigerator 100, the CMS 106 being configured to be fixedly repositionable (e.g., for top mount or bottom mount, or side by side), and/or the CMS 106 being configured to be repositionable during manufacturing (e.g., at the factory) and/or by the consumer, have repositionable doors, the CMS 106 can have shared or dedicated wiring, or a combination thereof. With such a repositionable CMS 106, different product configurations can be designed at the manufacturing level utilizing the same CMS 106. By way of explanation and not limitation as shown generally in FIGS. 13-15, the CMS 106 can be at least partially enclosed in the mullion 122, and the mullion 122 can be shifted to alter a ratio of the freezer compartment 102 and the refrigerator compartment 104. If the consumer can adjust the ratio of the freezer and refrigerator compartments, the doors may be reconfigurable, such as, but not limited to, a roller accordion door, a collapsible door, the like, or a combination thereof, or readily removed and replaced with a differently sized door designed to match the change in size of the access openings of the freezer compartment and the refrigerator compartment.

The mullion 122 can be configured to enclose one or more cold air conduits 125, 127 from the CMS 106, according to one embodiment. The mullion can be configured as a structured member with a first integrated air conduit for supplying chilled air to one of the freezer compartment and the refrigerator compartment and a second integrated air conduit for return air. Typically, the CMS 106 can have the first and second housings 118A, 1188, wherein one housing (e.g., the high side 108 or first housing 118A) can be fixed and a second housing (e.g., the low side 110 or second housing 1188) can be operably connected thereto, such as, but not limited to, rotatably connected. The second housing 1188 can be at least part of a wall. The connection between the high pressure side 108 and the low pressure side 110 can be a fluid connection.

Additionally, the high pressure side 108 can be in electrical communication with the low pressure side 110, either directly or indirectly (e.g., via other intermediate electrical components, such as, but not limited to, a controller).

Figure 4A:
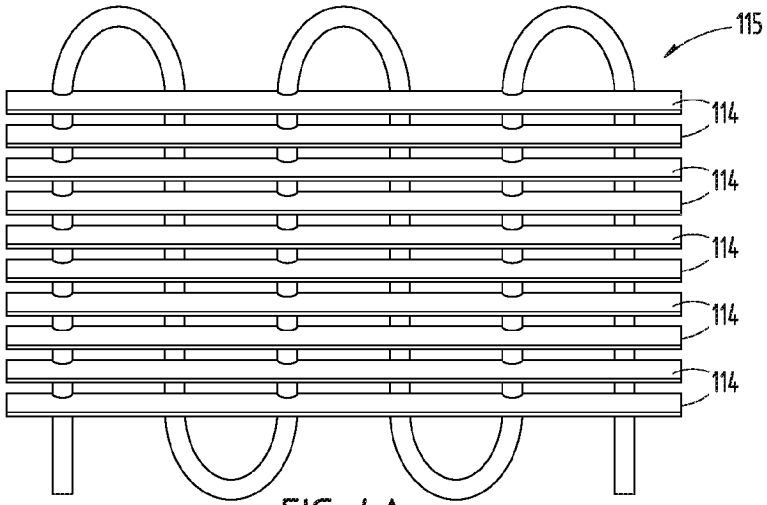
FIG. 4A is a front view of an evaporator including an evaporator coil and fins, in accordance with one embodiment of the present invention.
Figure 4B:
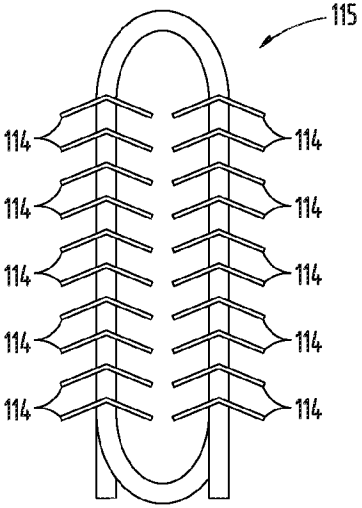
FIG. 4B is a side view of the evaporator of FIG. 4A.

According to one embodiment, as illustrated in FIG. 4, the evaporator coil 115 can include a plurality of fins 114 configured to have a contour allowing defrost water to move across the contour and off of the fins 114 when the CMS 106 is in one of a plurality of orientations. Typically, under operating conditions, frost can accumulate off of the fins 114 and the evaporator coil 115, and the frost can be removed by defrosting and allowing the frost to melt and drop from the fins 114 and coil 115. By configuring the fins 114 in a "V" shape, when the evaporator is in a horizontal position, the "V" can be oriented downward so the moisture falls by gravity.

Advantageously, the refrigerator 100 and the CMS 106 can be configured so that the CMS can be a standard design and function within various types of models of the refrigerator 100. Thus, the CMS 106 can have the same design while being located in different operating orientations within the refrigerator 100. It should be appreciated by those skilled in the art that additional or alternative advantages may be present from the refrigerator 100 and CMS 106. It should further be appreciated by those skilled in the art that the components described herein may be combined in different or alternative manners not explicitly described herein.

Figure 13A:
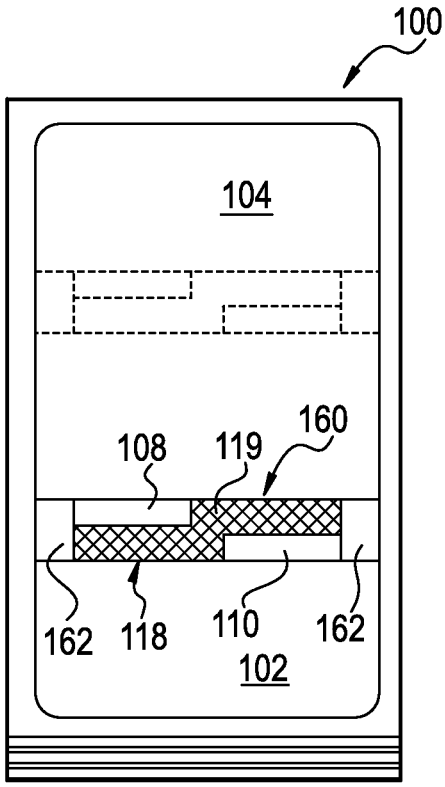
FIGS. 13*a* and 13*b* are schematic diagrams of a horizontally positioned cooling module set within an optionally repositionable horizontal mullion in a freezer bottom mount configuration, in accordance with one embodiment of the present invention with 13*b* showing an access port cut into the appliance cabinet for egress of condensing unit heat.
Figure 13B:
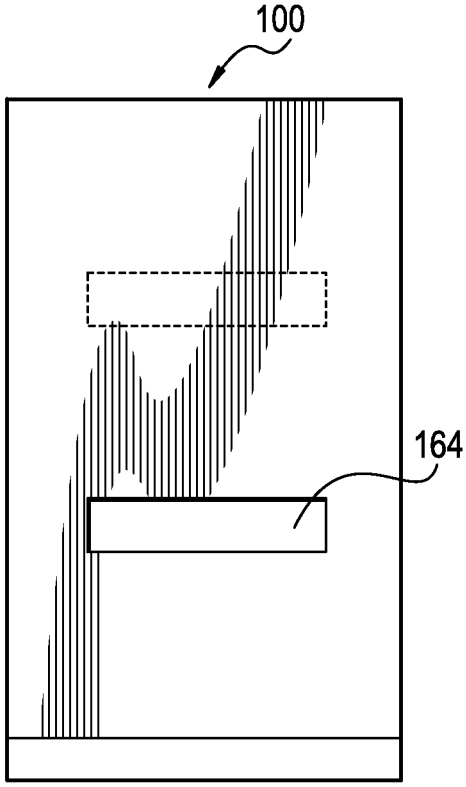

As shown in FIGS. 13*a* and 13*b*, a bottom mount freezer configuration is shown. Freezer compartment 102 is separated by the mullion 160 containing the CMS. The CMS may occupy a position within the mullion anywhere along the length of the mullion including making up the entirety of the mullion, the left side, the right side, or the middle of the mullion with the remainder of the mullion either being non-insulated housing or more typically an insulated housing. The typically insulated housing portions 162 are typically of a length sufficient to bridge between the exterior walls of a standardized cabinet. As shown in FIG. 13*a* with the dashed depiction of the mullion, the mullion section can be repositioned to enlarge the freezer section if so desired. FIG. 13*b* shows the configuration access port 164, which is cut into the generic cabinet for egress of condensing unit heat. As such, the CMS can be assembled to the cabinet from the front or from behind if a large enough access port is provided. A plurality of configuration access ports may be configured in the appliance cabinet and sealed with a removable (typically insulated) plug or covering when one or more of the configuration access ports are not operably engaged with the cooling module set.

Figure 14A:
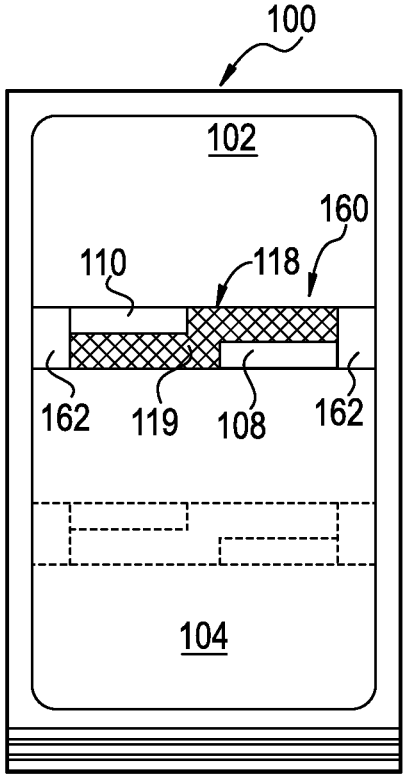
FIGS. 14*a* and 14*b* are schematic diagrams of an optionally repositionable horizontally positioned cooling module set within an optionally repositionable vertical mullion in a freezer top mount configuration in accordance with one embodiment of the present invention.
Figure 14B:
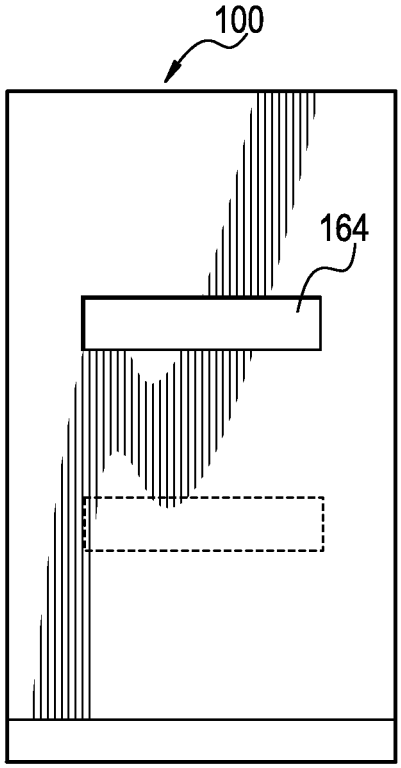
Figure 15A:
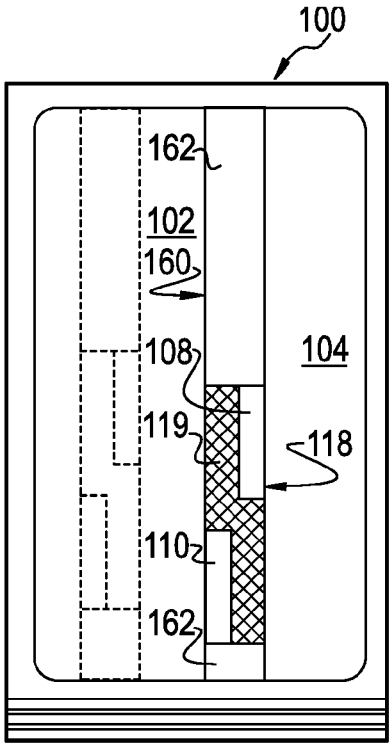
FIGS. 15*a* and 15*b* are schematic drawings of an optionally repositionable vertically positioned cooling module set within an optionally repositionable vertical mullion in a freezer top mount configuration in accordance with one embodiment of the present invention, with 15*b* showing an access port cut into the appliance cabinet for egress of condensing unit heat.
Figure 15B:
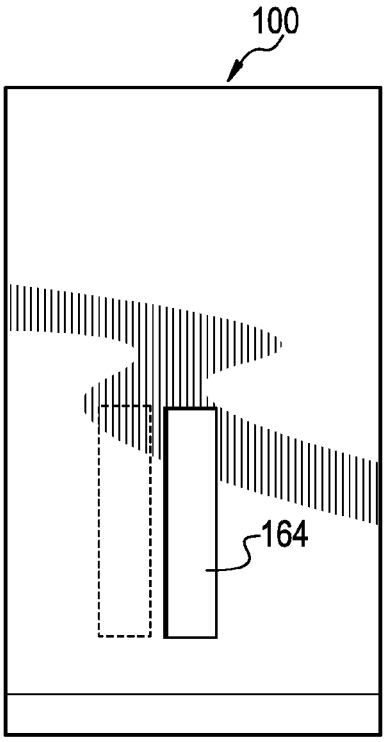
Figure 16A:
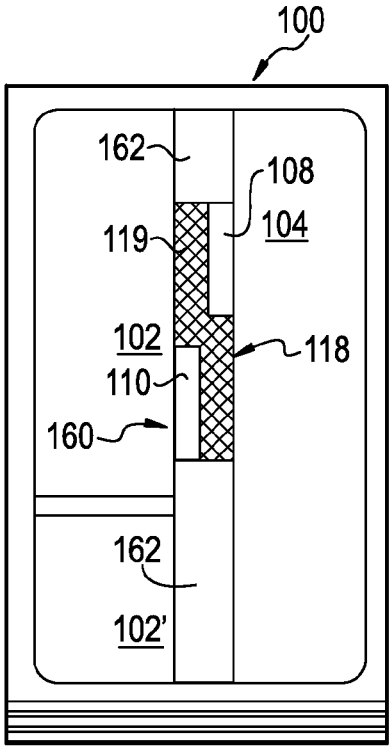
FIGS. 16*a* and 16*b* are schematic drawings of an optionally repositionable vertically positioned cooling module set within an optionally repositionable vertical mullion in a freezer top mount configuration in accordance with one embodiment of the present invention, with 16*b* showing an access port cut into the appliance cabinet for egress of condensing unit heat and incorporating a divided freezer compartment.
Figure 16B:
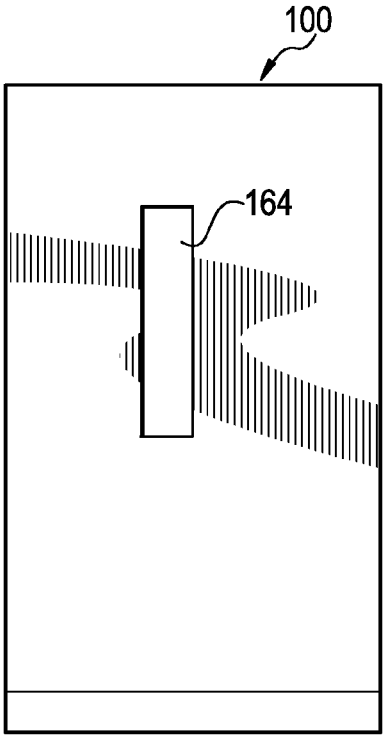

A similar depiction is shown in FIGS. 14*a* and 14*b*, which depict a top mount freezer-type refrigerator appliance. FIGS. 15*a* and 15*b* similarly show a side by side freezer configuration. The typically insulated, but optionally non-insulated portions 162 of the vertically oriented mullion section are typically longer due to the length necessary to traverse between the top wall and the bottom wall of the refrigerator 100. Finally, FIGS. 16*a* and 16*b* show a configuration with a divided freezer portion 102 and 102'. The configuration access ports 164 can be cut into the generic cabinet at various locations and the appliance potentially reconfigured during production of the appliance at the factory after the production of the appliance at the factory, which would allow for consumer adjustment of the ratio of the volume of the freezer compartment to the volume of the refrigerator compartment within the appliance.

It is to be understood that variations and modifications can be made on the aforementioned structure without departing from the concepts of the present invention, and further it is to be understood that such concepts are intended to be covered by the following claims unless these claims by their language expressly state otherwise.

The invention claimed is:

1. An appliance comprising:

an appliance cabinet comprising at least one freezer compartment;

at least one refrigerator compartment; and a cooling module set containing mullion adapted to define at least a portion of an envelope of at least one of said freezer compartment and said refrigerator compartment, wherein said cooling module set is configured to cool at least one of the at least one freezer compartment and the at least one refrigerator compartment using convective cooling, wherein the containing mullion comprises a cooling module set housing that comprises:

a high pressure side comprising a condenser;

a low pressure side fluidly connected to said high pressure side, said low pressure side comprising an evaporator;

at least one housing configured to enclose at least one of said condenser and said evaporator; and an insulating panel forming at least a portion of said at least one housing, and separating said high pressure side from said low pressure side;

wherein said cooling module set containing mullion is configured to operate in a plurality of orientations including at least both a horizontal orientation and a vertical orientation without affecting the operation of the orientation flexible compressor.

2. The appliance of claim 1, wherein the appliance is a refrigerator and wherein the cooling module set is configured to operate when positioned in approximately a vertical position in parallel with a normal operating orientation of the refrigerator, approximately horizontally with respect to the normal operating orientation of the refrigerator, rotated approximately ninety degrees) (90°) (e.g., +/−90° from an axis of origin), rotated approximately one hundred eighty degrees) (180°) (e.g., +/−180° from an axis of origin), rotated approximately two hundred seventy degrees (270°) (e.g., +/−270° from an axis of origin), or a combination thereof.

3. The appliance of claim 2, wherein said orientation-flexible compressor is an oil-less compressor and wherein the cooling module set further comprises a condenser fan configured to move air across the condenser and an evaporator fan configured to move air across the evaporator and wherein both the condenser fan and the evaporator fan are within the cooling module set housing.

4. The appliance of claim 3, wherein said evaporator comprises an evaporator coil housing a plurality of V-shaped fins configured to have a contour allowing moisture to move across said contour and off of said fins when said cooling module set is in the plurality of orientations.

5. The appliance of claim 1, wherein the appliance is a refrigerator and wherein said cooling module set is configured to operate when positioned at least one of approximately vertically in parallel with a normal operating orientation of the refrigerator, approximately horizontally with respect to said normal operating orientation of the refrigerator, rotated approximately ninety degrees) (90°) about an x-axis, and rotated approximately one hundred eighty degrees (180°) about a z-axis.

6. The appliance of claim 1, wherein the appliance further comprises a mullion configured to define at least a portion of at least one of said freezer compartment and said refrigerator compartment, said mullion is further configured to be positioned and extend one of approximately vertical with respect to a normal operating position of the refrigerator and approximately horizontal with respect to a normal operating position of the refrigerator, wherein at least a portion of said low pressure side is integrated with said mullion.

7. The appliance of claim 1, wherein said insulated panel defines a substantial portion of a wall section of at least one of said refrigerator compartment and said freezer compartment.

8. The appliance of claim 7, wherein said insulated wall section is substantially comprised of a vacuum panel insulated wall section.

9. The appliance of claim 1, wherein said insulated panel defines a substantial portion of a door section of one of said refrigerator compartment and said freezer compartment.

10. The appliance of claim 1, wherein said insulated panel is configured to insulate against heat gain from external conditions with respect to said low side.

11. The appliance of claim 1, wherein said at least one housing comprises first and second housings that are operably connected, and said first housing encloses at least the orientation-flexible compressor, the condenser, and a condenser fan, and said second housing encloses at least an evaporator coil, an evaporator fan, and a defroster device.

12. The appliance of claim 11, wherein said operable connection of said first and second housings is a rotatable connection.

13. The appliance of claim 1 further comprising the mullion configured as a structural member with a first integrated air conduit for supplying chilled air to one of said freezer compartment and said refrigerator compartment, and a second integrated air conduit for return air.

14. A appliance comprising:

at least one freezer compartment;

at least one refrigerator compartment; and a cooling module set adapted to define at least a portion of an envelope of at least one of said freezer compartment and said refrigerator compartment wherein said cooling module set comprises:

a high pressure side comprising:

an orientation-flexible compressor configured to be mounted in a plurality of orientations including at least both a horizontal orientation and a vertical orientation without affecting the operation of the orientation-flexible compressor;

a condenser fluidly connected with said orientation-flexible compressor; and a condenser fan;

a low pressure side fluidly connected to said high pressure side, said low pressure side comprising:

an evaporator comprising:

a defroster device;

an evaporator fan; and an evaporator coil that comprises a plurality of fins configured to have a contour allowing moisture to move across said contour and off of said fins when said cooling module set is in one of a plurality of orientations;

at least one housing configured to enclose at least one of said orientation-flexible compressor, said condenser, and said evaporator; and an insulating panel forming at least a portion of said at least one housing, and substantially separating said high pressure side from said low pressure side, and configured to insulate against heat gain from external conditions with respect to said low pressure side; and wherein said cooling module set is configured to operate in said plurality of orientations based upon of said orientation-flexible compressor and said evaporator coil, said plurality of orientations comprising approximately vertically in parallel with a normal operating orientation of the refrigerator, approximately horizontally with respect to said normal operating orientation of the refrigerator, rotated approximately ninety degrees (90°) about an x-axis, rotated approximately one hundred eighty degrees (180°) about a z-axis.

15. The appliance of claim 14, wherein said insulated panel defines a substantial portion of a wall section of at least one of said refrigerator compartment and said freezer compartment.

16. The appliance of claim 15, wherein said insulated wall section is substantially comprised of a vacuum panel insulated wall section and wherein the plurality of fins are V-shaped and configured to allow frost on the fins to melt and drop from the fins and the evaporator coil by gravity.

17. The appliance of claim 14, wherein said at least one housing comprises first and second housings that are hingedly connected and wherein the cooling module set is configured to operate can be configured to operate when positioned in approximately a vertical position in parallel with a normal operating orientation of the refrigerator, approximately horizontally with respect to the normal operating orientation of the refrigerator, rotated approximately ninety degrees (90°) (e.g., +/−90° from an axis of origin), rotated approximately one hundred eighty degrees (180°) (e.g., +/−180° from an axis of origin), rotated approximately two hundred seventy degrees (270°) (e.g., +/−270° from an axis of origin), or a combination thereof.

18. The appliance of claim 14 further comprising a mullion configured to be positioned and extend one of approximately vertical with respect to a normal operating position of the refrigerator and approximately horizontal with respect to a normal operating position of the refrigerator, wherein at least a portion of said low pressure side is integrated with said mullion, the mullion is further configured to define at least a portion of at least one of said freezer compartment and said refrigerator compartment.

19. The appliance of claim 14, wherein the orientation-flexible compressor is an oil-less, orientation-flexible compressor.

20. A cooling module set adapted to define at least a portion of at least one of a freezer compartment and a refrigerator compartment in a refrigerator, wherein said cooling module set comprises:

a high pressure side comprising:

an orientation-flexible compressor configured to be mounted in a plurality of orientations including at least both a horizontal orientation and a vertical orientation without effecting the operation of the orientation-flexible compressor; and a condenser fluidly connected with said orientation-flexible compressor;

a low pressure side fluidly connected to said high pressure side, said low pressure side comprising:

an evaporator comprising:

an evaporator fan; and an evaporator coil that comprises a plurality of V-shaped fins configured to have a contour allowing moisture to move across said contour and off of said fins when said cooling module set is in one of a plurality of orientations;

at least one housing configured to enclose at least one of said orientation-flexible compressor, said condenser, said evaporator fan, and said evaporator coil; and an insulating panel forming at least a portion of said at least one housing, and substantially separating said high pressure side from said low pressure side; and wherein said cooling module set is configured to operate in said plurality of orientations based upon said orientation-flexible compressor and said evaporator coil, said plurality of orientations comprising approximately vertically in parallel with a normal operating orientation of the refrigerator, approximately horizontally with respect to said normal operating orientation of the refrigerator, rotated approximately ninety degrees (90°) about an x-axis, and rotated approximately one hundred eighty degrees (180°) about a z-axis.

21. The cooling module set of claim 20, wherein the orientation-flexible compressor is an oil-less, orientation-flexible compressor.

22. A method of producing an appliance comprising the steps of:

forming an insulated appliance cabinet having an interior and an exterior defined by walls; and installing a cooling module set comprising: at least one cooling module set housing containing a low pressure side and a high pressure side capable of operation sufficient to allow the cooling module set to perform its cooling function within a plurality of orientations including at least when an orientation flexible compressor is oriented vertically or when the orientation flexible compressor is oriented horizontally without modification to the orientation flexible compressor, wherein the at least one cooling module set is installed such that the cooling module set housing forms at least one of the following structures chosen from the group consisting of: at least a portion of a vertical mullion within the interior and defining at least a portion of the appliance cabinet walls.

23. The method of claim 22, wherein the cooling module set further comprises an orientation-flexible compressor capable of operation in a plurality of orientations, without any modifications being made to the cooling modules set including when the cooling module set is horizontally position and when the cooling module set is positioned vertically wherein the low pressure side and the high pressure side are with a cooling module set housing and an insulating panel is positioned within the cooling module set housing and configured to insulate the low pressure side from the high pressure side.

24. The method of claim 23, wherein the insulated cabinet further comprises at least one configuration access port that is operably connected to the at least one cooling module set housing to allow for the egress of heat from the cooling module set to the environment outside of the insulated appliance cabinet and wherein the cooling module set is configured to operate can be configured to operate when positioned in approximately a vertical position in parallel with a normal operating orientation of the refrigerator, approximately horizontally with respect to the normal operating orientation of the refrigerator, rotated approximately ninety degrees (90°) (e.g., +/−90° from an axis of origin), rotated approximately one hundred eighty degrees (180°) (e.g., +/−180° from an axis of origin), rotated approximately two hundred seventy degrees (270°) (e.g., +/−270° from an axis of origin), or a combination thereof.

25. The method of claim 24, wherein the insulated appliance cabinet further comprises a plurality of configuration access ports that are each capable of operably connecting to the cooling module set to allow for the egress of heat from the cooling module set to the environment outside of the insulated appliance cabinet.

* * * * *